US005484094A

United States Patent [19]

Gupta

[11] Patent Number: 5,484,094

[45] Date of Patent: Jan. 16, 1996

[54] WORKPIECE-CONTACTING PROBE FOR FASTENER-DRIVING TOOL FOR FASTENING LATH TO SUBSTRATE

[75] Inventor: Harish C. Gupta, Naperville, Ill.

[73] Assignee: Illinois Tool Works Inc., Glenview, Ill.

[21] Appl. No.: 260,899

[22] Filed: Jun. 16, 1994

[51] Int. Cl.[6] ..... B25C 1/04

[52] U.S. Cl. ..... 227/8; 227/113; 227/119; 227/120; 227/142

[58] Field of Search ..... 227/113, 120, 227/8, 119, 142

[56] References Cited

U.S. PATENT DOCUMENTS

| | | | |
|---|---|---|---|
| 3,612,378 | 10/1971 | Pabich et al. | 227/120 |
| 3,734,377 | 5/1973 | Munn | 227/120 |
| 4,227,637 | 10/1980 | Haytayan | 227/113 |
| 4,339,065 | 7/1982 | Haytayan | 227/120 |
| 4,485,952 | 12/1984 | Weis | 227/113 |
| 5,042,142 | 8/1991 | Beach | 227/120 |
| 5,197,646 | 3/1993 | Nikolich | 227/8 |

*Primary Examiner*—Scott A. Smith
*Attorney, Agent, or Firm*—Schwartz & Weinrieb

[57] ABSTRACT

In a fastener-driving tool, which may be a pneumatically powered or combustion-powered pin-driving or nail-driving tool, and which comprises a nosepiece and is adapted to drive a fastener from the nosepiece, through a workpiece, into a substrate, a workpiece-contacting probe comprising two permanent magnets is mounted to the nosepiece for magnetically and releasably holding a washer plate made of magnetizable steel between the nosepiece and a workpiece. Thus, a fastener driven from the nosepiece is driven through a washer plate held by the workpiece-contacting probe, through a workpiece, into a substrate. The workpiece-contacting probe adapts the fastener-driving tool particularly but not exclusively for fastening metal lath to concrete walls, concrete blocks, or other building substrates.

20 Claims, 2 Drawing Sheets

2
10
12
44
20
40
22
42

70
84
90
94
78

22
26
28
82
24
3
70
44
40
72
50
74
52
76
80
20
12
92
96
30
16
84
3

WORKPIECE-CONTACTING PROBE FOR FASTENER-DRIVING TOOL FOR FASTENING LATH TO SUBSTRATE

TECHNICAL FIELD OF THE INVENTION

This invention pertains to a workpiece-contacting probe for a fastener-driving tool, which has a nosepiece, and which is adapted to drive a fastener from the nosepiece, through a workpiece, into a substrate. The workpiece-contacting probe comprises means for holding a washer plate releasably across the nosepiece, whereby a fastener driven from the nosepiece is driven against a washer plate held by the holding means. The workpiece-contacting probe adapts the fastener-driving tool particularly but not exclusively for fastening metal lath, of a type having a mesh of thin ribs bounding large apertures, to concrete walls, concrete blocks, or other building substrates.

BACKGROUND OF THE INVENTION

In fastening a metal lath of the type noted above to concrete walls, concrete blocks, or other building substrates, it has been common to employ thin circular or otherwise configured plates or annular washers of relatively large sizes commonly known as latch disks with fasteners having heads of relatively small sizes, such as steel pins or wire nails, which are driven by combustion-powered tools or by pneumatically powered tools.

Generally, steel pins are hardened and are used with concrete substrates and with masonry substrates, whereas wire nails are not hardened and are used with wooden substrates. Commonly, hardened steel pins are employed with washer plates without central apertures because such pins can penetrate such plates, whereas wire nails are employed with washer plates or lath disks having central apertures. References herein to washer plates are intended to encompass washer plates or lath disks with or without central apertures.

Heretofore, there has not been an entirely satisfactory way to hold a washer plate while a fastener is being driven by a combustion-powered or pneumatically powered tool.

SUMMARY OF THE INVENTION

This invention provides a workpiece-contacting probe for a fastener-driving tool including a nosepiece and adapted to drive a fastener from the nosepiece, through a workpiece, into a substrate. Broadly, the workpiece-contacting probe comprises means mountable to the nosepiece for releasably holding a washer plate across the nosepiece when mounted to the nosepiece and means for mounting the workpiece-contacting probe to the nosepiece, whereby a fastener driven from the nosepiece is driven against a washer plate held by the holding means.

Since a washer plate would be commonly made from a magnetizable steel, the holding means may comprise a permanent magnet, which is positioned along one side of the nosepiece when the workpiece-contacting probe is mounted to the nosepiece. Preferably, the magnet is one of two permanent magnets, which are positioned respectively on opposite sides of the nosepiece when the workpiece-contacting probe is mounted to the nosepiece.

The workpiece-contacting probe adapts the fastener-driving tool particularly but not exclusively for fastening mesh-like lath to concrete walls, concrete blocks, Or other building substrates.

BRIEF DESCRIPTION OF THE DRAWINGS

These and other objects, features, and advantages of this invention will become evident from the following description of a preferred embodiment of this invention with reference to the accompanying drawings, in which like reference characters designate like or corresponding parts throughout the several views, and wherein.

DETAILED DESCRIPTION OF PREFERRED EMBODIMENT

Figure 1:
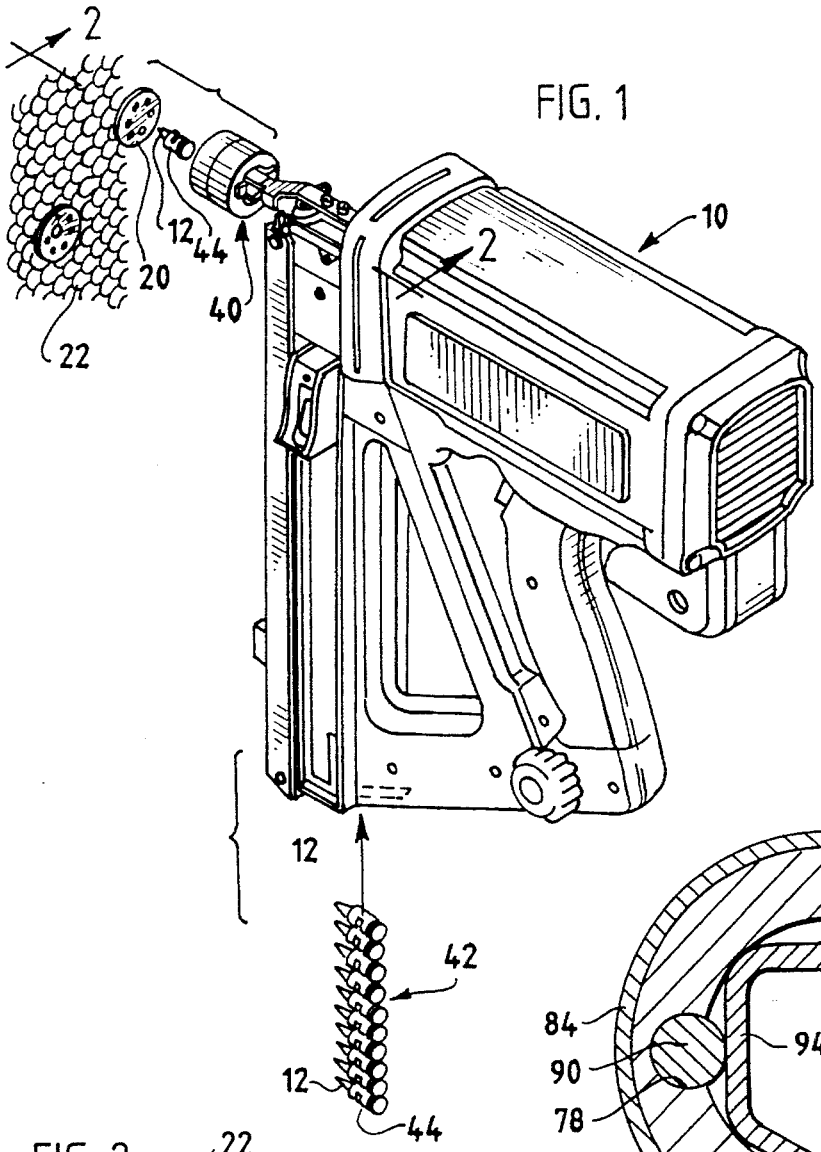
FIG. 1 is an exploded, perspective view of a fastener-driving tool including a workpiece-contacting probe embodying this invention, as taken from one vantage point. The tool including the probe is shown as used for fastening mesh-like lath to a concrete substrate.
Figure 2:
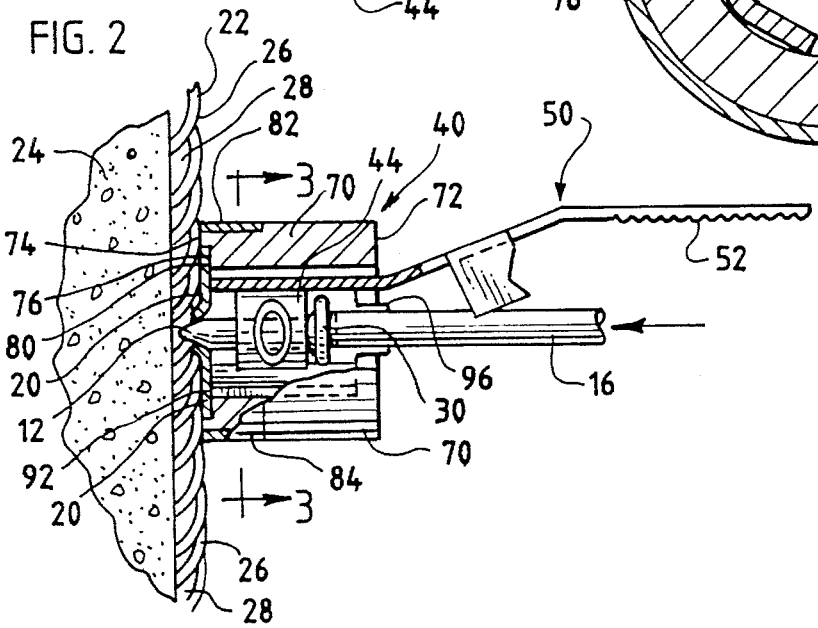
FIG. 2, on an enlarged scale, is a partly fragmentary, sectional view taken along line 2—2 of FIG. 1, in a direction indicated by the arrows.

As shown in FIGS. 1 and 2, a fastener-driving tool 10 is used to drive a steel pin 12 from a nosepiece 14 of the tool 10, through a washer plate 20, through a metal lath 22 of the type noted above, into a concrete substrate 24, against which the metal lath 22 is disposed. As shown in FIG. 2, the tool has a driving ram 16, which is forcibly driven so as to drive the steel pin 12.

The metal lath 22 has a mesh of thin ribs 26 defining large apertures 28. Although the steel pin 12 has a head 30 of a relatively small size, which would easily pass through those apertures 28, the washer plate 20 bridges such ribs 26 so as to prevent the head 30 of the steel pin 12 from passing therethrough. This invention provides a workpiece-contacting probe 40, which differs from workpiece-contacting members known heretofore, for releasably holding the washer plate 20 across the nosepiece 14 when the steel pin 12 is driven from the nosepiece 14.

Preferably, as shown, the tool 10 is a combustion-powered tool of a type exemplified in Nikolich U.S. Pat. No. Re. 32,452 and Nikolich U.S. Pat. No. 5,197,646 and arranged for driving steel pins, as commercially available from ITW Ramset/Red Head (a unit of Illinois Tool Works Inc.) of Wood Dale, Ill. Preferably, moreover, the steel pin 12 is fed into the tool 10 by means of a strip 42, in which a large number of such pins 12 are carried by polymeric sleeves 44, as illustrated and described in Ernst et al. U.S. Pat. No. 5,069,340.

Alternatively, the fastener-driving tool 10 is a pneumatically powered tool of a type exemplified in Golsch U.S. Pat. No. 4,932,480 and arranged for driving wire nails, as commercially available from ITW Paslode (a unit of Illinois Tool Works Inc.) of Lincolnshire, Ill., or a powder-actuated tool of a type employing a powder charge and available commercially from ITW Ramset/Red Head, supra.

Conventionally, a fastener-driving tool of any of the types mentioned above has a workpiece-contacting member, which must be firmly pressed against a workpiece, against a spring biasing force so as to enable the fastener-driving tool to be further actuated for driving a fastener. For the purposes of this invention, the workpiece-contacting probe 40 replaces the workpiece-contacting member that would be conventionally employed. Thus, the workpiece-contacting probe 40 must be firmly pressed against a workpiece, such as the metal lath 22 disposed against the concrete substrate 24, so as to enable the fastener-driving tool 10 to be further actuated for driving a steel pin 12.

Figure 4:
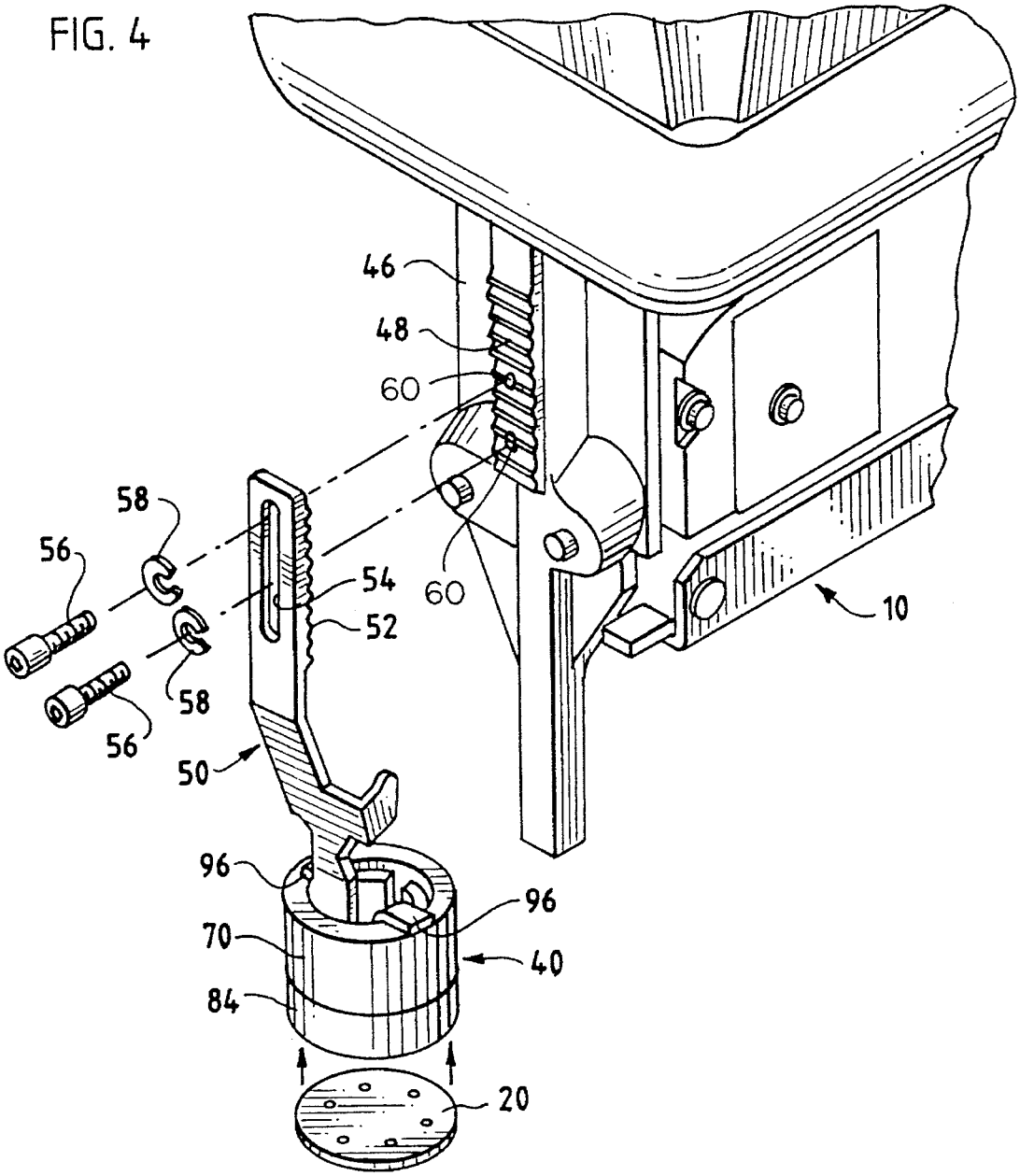
FIG. 4, on an intermediate scale, is an exploded, perspective view of the tool including the probe, as taken from another vantage point.

As shown in FIG. 4, the fastener-driving tool 10 has an actuating member 46, which must be pressed inwardly against the spring biasing force into such tool 10 so as to enable the fastener-driving tool 10 to be further actuated for driving a steel pin 12.

The actuating member 46 is provided along a rugose surface 48 with a series of ribs and grooves in an alternating pattern. The workpiece-contacting probe 40 has a mounting bracket 50, which is provided along a rugose surface 52, facing the rugose surface 48, with a series of ribs and grooves in a complementary pattern, and which is adjustably mounted to the actuating member 46 so that selected ribs on the surfaces 48, 52, fit into selected grooves in the surfaces 48, 52. The mounting bracket 50 has an elongate slot 54 and is adjustably mounted to the actuating member 46 by means of two machine screws 56, each carrying a lock washer 58 and passing through the elongate slot, into a threaded socket 60 in the actuating member 46. The threaded sockets 60 open at the external surface 48. Thus, when the workpiece-contacting probe 40 is pressed firmly against a workpiece, such as the metal lath 22 disposed against the concrete substrate 24, the fastener-driving tool 10 can be further actuated for driving a steel pin 12. Details of the manner whereby the fastener-driving tool 10 can be further actuated are outside the scope of this invention.

Figure 3:
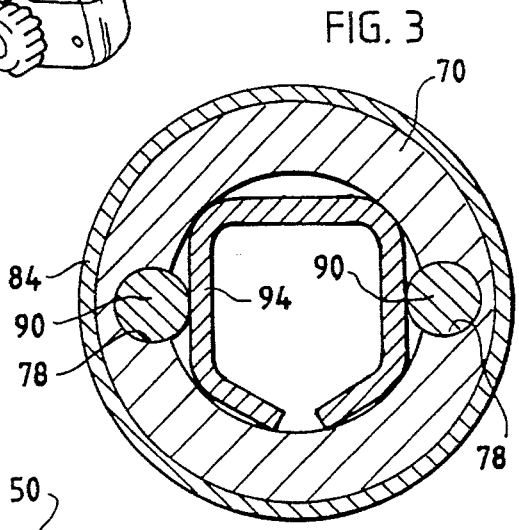
FIG. 3, on a further enlarged scale, is a sectional view taken along line 3—3 of FIG. 2, in a direction indicated by the arrows.

As shown, the workpiece-contacting probe 40 has a tubular body 70 defining an axis and having an inlet end 72, an outlet end 74, and an interior, annular recess 76 at the outlet end 74. Further, the tubular body 70 has two diametrically opposed, substantially cylindrical sockets 78 extending axially into the tubular body 70, from an annular surface 80 of the annular recess 76. As shown in FIG. 3, the sockets 78 open into the tubular body 70. The tubular body 70 has an exterior, annular recess 82, along which a sleeve 84 is pressed. The sleeve 84 reinforces the tubular body 70, which is weakened where the sockets 78 are provided.

Two cylindrical, permanent magnets 90 are mounted so as to be respectively positioned on opposite sides of the nosepiece 14. Each magnet 90 extends axially into one of the sockets 78 so that an exposed end 92 of each magnet 90 is flush with the annular surface 80 of the annular recess 76. Thus, the magnets 90 are arranged for releasably holding a washer plate 20 within the annular recess 76 if the washer plate 20 has a suitable diameter to fit therewithin, and if the washer plate 20 is made of a magnetizable steel.

The mounting bracket 50 is formed so as to have a generally U-shaped portion 94 pressed into the tubular member 70, from the inlet end 72, so as to secure the mounting bracket 50 to the tubular member 70 and so as to secure the magnets 90 where the sockets 78 open into the tubular body 70. Also, the mounting bracket 50 is formed so as to have two diametrically opposed, outwardly extending flanges 96, which overlie the inlet end 72 of the tubular body 70. The flanges 96 properly locate the mounting bracket 50 when the generally U-shaped portion 94 is pressed into the tubular member 70. The mounting bracket 50 is formed so that when the workpiece-contacting probe 40 is mounted to the nosepiece 14 at any adjustable position permitted by the surfaces 48, 52, a steel pin 12 can then be driven through the generally U-shaped portion 94 of the mounting bracket 50, along the axis defined by the tubular body 70.

If the fastener-driving tool 10 is operated so as to drive a steel pin 12 through the nosepiece 14 with the metal lath 22 disposed against the concrete substrate 24, with the workpiece-contacting probe 40 pressed against the metal lath 22, and with a washer plate 20 releasably held by the magnets 90, within the annular recess 76, between the nosepiece 14 and the metal lath 22, and if the fastener-driving tool 10 has sufficient power, the steel pin 12 is driven through the washer plate 20, through the metal lath 22, into the concrete substrate 24. Preferably, the steel pin 12 is driven through a large aperture 28, rather than through a rib 26of the metal lath 26. However, if the fastener-driving tool 10 has sufficient power, the steel pin 12 may be also driven through a rib 26 of the metal lath 22. After the steel pin 12 has been driven, the fastener-driving tool 10 can be easily pulled away.

Figure 5:
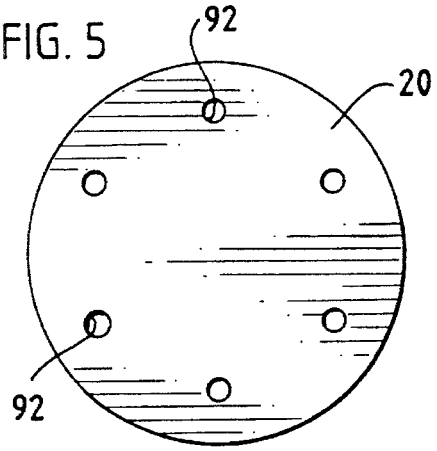
FIGS. 5 and 6, on a scale similar to the scale of FIG. 3, are plan views of two washer plates that may be alternatively used. The washer plate of FIG. 5 does not have a central aperture. The washer plate of FIG. 6 has a central aperture.
Figure 6:
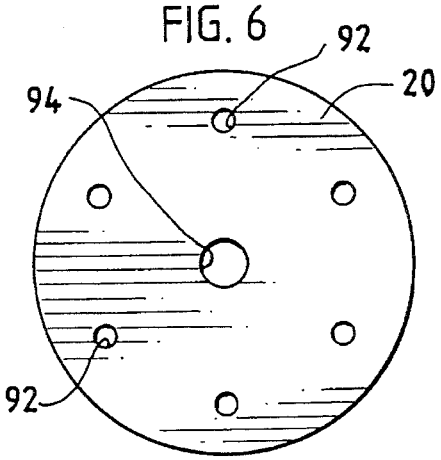

Preferably, the washer plate 20 is a circular disk made of a magnetizable steel, plated so as to be corrosion-resistant, and provided with an annular array of small openings 92, into which an overlying layer (not shown) of plaster or stucco can penetrate so as to promote adherence of the plaster or stucco layer. Preferably, as shown in FIG. 5, the washer plate 20 is made without a central aperture. Thus, when a steel pin 12 is driven through the washer plate 20, the steel pin 12 tends to form a frictional connection with the washer plate 20. Alternatively, the washer plate 20 is made with a central aperture 94, which may prove necessary if the fastener-driving tool 10 is arranged to drive wire nails (not shown) that are not hardened as a general practice, rather than steel pins that are hardened as a general practice.

Various modifications may be made in the preferred embodiment described above without departing from the scope and spirit of this invention.

I claim:

1. A fastener-driving tool, comprising:

a nosepiece;

means for driving a fastener from said nosepiece, through a workpiece, and into a substrate;

a safety actuating member movably mounted upon said tool for movement between an extended power-inhibiting position, and a retracted power-enabling position;

a workpiece-contacting probe having means disposed thereon for releasably holding a washer plate thereon; and means mounting said workpiece-contacting probe upon said safety actuating member for properly aligning said workpiece-contacting probe, and said washer plate housed thereon, with respect to said fastener driving means such that said fastener driving means can drive said fastener through said workpiece-contacting probe, through said washer plate, through said workpiece, and into said substrate, and for moving said safety actuating member from said extended power-inhibiting position to said power-enabling position so as to enable said tool when said workpiece-contacting probe is moved against said workpiece.

2. The fastener-driving tool of claim 1, wherein:

said holding means for releasably holding said washer plate comprises at least one permanent magnet which is positioned along one side of said workpiece-contacting probe.

3. The fastener-driving tool of claim 2, wherein:

said at least one magnet comprises a pair of permanent magnets which are positioned respectively upon diametrically opposite sides of said work-piece-contacting probe.

4. The fastener-driving tool as set forth in claim 3, wherein:

said workpiece-contacting probe comprises a tubular member; and bore means are defined within diametrically opposite sides of said tubular member for housing said pair of permanent magnets.

5. The fastener-driving tool as set forth in claim 4, wherein:

said means mounting said workpiece-contacting probe upon said safety actuating member comprises a mounting bracket having a first end portion thereof disposed interiorly within said tubular member of said workpiece-contacting probe, and a second end portion thereof adjustably mounted upon said safety actuating member so as to adjust the axial position of said workpiece-contacting probe with respect to said nosepiece of said tool.

6. The fastener-driving tool as set forth in claim 5, wherein said first end portion of said mounting bracket comprises:

a substantially U-shaped portion press-fitted within said tubular member of said workpiece-contacting probe; and a pair of diametrically opposed flanges for engaging external peripheral end portions of said tubular member of said work- piece-contacting probe.

7. The fastener-driving tool as set forth in claim 6, wherein:

said substantially U-shaped portion of said mounting bracket is coaxially disposed within said tubular member of said workpiece-contacting probe such that said driven fastener passes through said substantially U-shaped portion of said mounting bracket as said driven fastener passes through said workpiece-contacting probe when said driven fastener is driven by said fastener driving means.

8. The fastener-driving tool as set forth in claim 6, wherein:

said bore means for housing said magnets are open along an axially extending side wall portion thereof connecting each one of said bore means with the open interior of said tubular member; and said substantially U-shaped portion of said mounting bracket closes said open side wall portion of each one of said bore means so as to retain said permanent magnets within said bore means and to isolate said permanent magnets from said open central interior of said tubular member through which said fastener is driven by said fastener driving means.

9. The fastener-driving tool as set forth in claim 5, wherein:

said safety actuating member comprises a first ribbed section having fastener aperture means defined therein; and said second end portion of said mounting bracking comprises a second ribbed section which is complementary with respect to said first ribbed section of said safety actuating member so as to be adjustably engageable therewith, and an elongated slot defined within said second ribbed section for receiving fasteners therethrough for mating with said fastener aperture means of said first ribbed section of said safety actuating member whereby adjustment of said mounting bracket with respect to said safety actuating member is permitted.

10. The fastener-driving tool as set forth in claim 3, wherein:

said washer plate comprises magnetizable steel.

11. The fastener-driving tool as set forth in claim 1, further comprising:

recess means defined within a front face of said workpiece-contacting probe, which is disposed toward said workpiece, for housing said washer plate releasably held upon said workpiece-contacting probe by said holding means of said workpiece-contacting probe.

12. The fastener-driving tool as set forth in claim 1, wherein:

said washer plate is imperforate within a central portion thereof such that said fastener need not be driven through a predetermined area of said washer plate; and a plurality of apertures, arranged within an annular array, are defined within a peripheral portion of said washer plate for receiving bonding material therein.

13. The fastener-driving tool as set forth in claim 1, wherein:

said washer plate has an aperture defined within a central portion thereof for receiving said fastener when said fastener is driven through said workpiece-contacting probe, through said washer plate, through said workpiece, and into said substrate; and a plurality of apertures, arranged within an annular array, are defined within a peripheral portion of said washer plate for receiving bonding material therein.

14. A fastener-driving tool, comprising:

a nosepiece;

means for driving a fastener from said nosepiece, through a workpiece, and into a substrate;

a safety actuating member movably mounted upon said tool for movement between an extended power-inhibiting position, and a retracted power-enabling position;

a workpiece-contacting probe disposed forwardly of said nosepiece and having means disposed thereon for releasably holding a washer plate thereon such that said washer plate is interposed between said nosepiece and said workpiece; and means mounting said workpiece-contacting probe upon said safety actuating member for properly aligning said workpiece-contacting probe, and said washer plate housed thereon, with respect to said fastener driving means such that said fastener driving means can drive said fastener through said workpiece-contacting probe, through said washer plate, through said workpiece, and into said substrate, and for moving said safety actuating member from said extended power-inhibiting position to said power-enabling position so as to enable said tool when said workpiece-contacting probe is moved against said workpiece.

15. The fastener-driving tool of claim 14, wherein:

said holding means for releasably holding said washer plate comprises a pair of permanent magnets which are positioned respectively upon diametrically opposite sides of said workpiece-contacting probe.

16. The fastener-driving tool of claim 15, wherein:

said workpiece-contacting probe comprises a tubular member; and bore means are defined within diametrically opposite sides of said tubular member for housing said pair of permanent magnets.

17. The fastener-driving tool as set forth in claim 5, wherein:

said means mounting said workpiece-contacting probe upon said safety actuating member comprises a mounting bracket having a first end portion thereof disposed internally within said tubular member of said workpiece-contacting probe, and a second end portion thereof adjustably mounted upon said safety actuating member so as to adjust the axial position of said workpiece-contacting probe with respect to said nosepiece of said tool.

18. The fastener-driving tool as set forth in claim 17, wherein said first end portion of said mounting bracket comprises:

a substantially U-shaped portion press-fitted within said tubular member of said workpiece-contacting probe so as to be coaxially disposed within said tubular member of said workpiece-contacting probe such that said driven fastener passes through said substantially U-shaped portion of said mounting bracket as said driven fastener passes through said workpiece-contacting member when said driven fastener is driven by said fastener driving means toward said workpiece and said substrate; and a pair of diametrically opposite flanges for engaging external peripheral end portions of said tubular member of said workpiece-contacting probe.

19. The fastener-driving tool as set forth in claim 18, wherein:

said bore means for housing said pair of permanent magnets are open along an axially extending side wall portion thereof connecting each one of said bore means with the open central interior portion of said tubular member; and opposite side portions of said substantially U-shaped portion of said mounting bracket close said open side wall portions of said bore means so as to retain said permanent magnets within said bore means and to isolate said permanent magnets from said open central interior portion of said tubular member through which said fastener is driven by said fastener driving means.

20. The fastener-driving tool as set forth in claim 6, further comprising:

recess means defined within a front face of said workpiece-contacting probe, which is disposed toward said workpiece and said substrate, for housing said washer plate releasably held upon said workpiece-contacting probe by said pair of permanent magnets; and said washer plate comprises magnetizable steel.

* * * * *